US008899399B2

(12) United States Patent
Nomura

(10) Patent No.: US 8,899,399 B2
(45) Date of Patent: Dec. 2, 2014

(54) BANKNOTE PROCESSING MACHINE AND BANKNOTE PROCESSING METHOD

(71) Applicant: Glory Ltd., Himeji (JP)

(72) Inventor: Eiichi Nomura, Himeji (JP)

(73) Assignee: Glory Ltd., Himeji-Shi, Hyogo-Ken (JP)

( * ) Notice: Subject to any disclaimer, the term of this patent is extended or adjusted under 35 U.S.C. 154(b) by 0 days.

(21) Appl. No.: 14/018,533

(22) Filed: Sep. 5, 2013

(65) Prior Publication Data

US 2014/0069770 A1 Mar. 13, 2014

(30) Foreign Application Priority Data

Sep. 7, 2012 (JP) ..... 2012-197652

(51) Int. Cl.
*G07F 7/04* (2006.01)
*E05G 1/14* (2006.01)
*G07D 11/00* (2006.01)

(52) U.S. Cl.
CPC .. *G07F 7/04* (2013.01); *E05G 1/14* (2013.01); *G07D 11/0009* (2013.01); *G07D 11/0057* (2013.01); *G07D 11/006* (2013.01)
USPC ..... 194/206; 109/25

(58) Field of Classification Search
CPC ..... G07F 7/04; G07D 13/00; E05G 1/14
USPC ..... 194/202, 204, 206; 235/379; 209/534; 109/24.1, 25, 29, 32, 34; 700/215, 225, 700/226
See application file for complete search history.

(56) References Cited

U.S. PATENT DOCUMENTS

| | | | | |
|---|---|---|---|---|
| 6,540,136 | B1 * | 4/2003 | Ross | 235/379 |
| 2005/0051448 | A1 * | 3/2005 | Miles et al. | 206/459.1 |
| 2005/0189266 | A1 * | 9/2005 | Fujita et al. | 209/534 |
| 2009/0235847 | A1 | 9/2009 | Villiger | |

FOREIGN PATENT DOCUMENTS

| | | | |
|---|---|---|---|
| EP | 1 471 474 | A1 | 10/2004 |
| EP | 2 410 497 | A1 | 1/2012 |
| JP | 9-161124 | | 6/1997 |
| JP | 2011-113372 | | 6/2011 |
| WO | WO 2009/022955 | A1 | 2/2009 |
| WO | WO 2010/074636 | A1 | 7/2010 |

OTHER PUBLICATIONS

European Search Report (Application No. 13183298.2) (7 pages—dated Mar. 1, 2014).

* cited by examiner

*Primary Examiner* — Mark Beauchaine
(74) *Attorney, Agent, or Firm* — Renner, Kenner, Greive, Bobak, Taylor & Weber

(57) ABSTRACT

A controller 50 of a banknote processing machine 10 is configured to selectively perform a leaving mode, in which the banknote is fed out from each of the storing/feeding units 28, transported to the first cassette (recycle cassette 42) by the transport unit 24, and stored and left in the first cassette, when the first cassette is accommodated in the cassette accommodation unit 40.

14 Claims, 6 Drawing Sheets

BANKNOTE PROCESSING MACHINE AND BANKNOTE PROCESSING METHOD

CROSS REFERENCE TO RELATED APPLICATIONS

This application claims the benefit of priority from the prior Japanese Patent Application No. 2012-197652 filed on Sep. 7, 2012, the entire contents of which are incorporated herein by reference.

BACKGROUND OF THE INVENTION

1. Field of the Invention

The present invention relates to a banknote processing machine and a banknote processing method, in which a cassette accommodation unit detachably accommodates a cassette configured to store a banknote therein and to feed out the stored banknote.

2. Related Art

Conventionally, in stores such as a convenience store and a supermarket, a money change machine is provided in a front area where a store clerk exchanges cash with a customer, and a money processing unit is provided in a backyard area where no customers are allowed to enter. In such stores, after the business hours, the money is collected from the money change machine provided in the front area, and stored in the money processing unit provided in the backyard area. Therefore, the money is managed by the money processing unit in the backyard area during the nighttime. Before the business hours on the next day, the money (change fund) used as change for the money change machine in the front area is dispensed from the money processing unit in the backyard area, and the dispensed change fund is stored in the money change machine in the front area. A security guard of a security company periodically collects the money from the money processing unit provided in the backyard area. For example, Japanese Patent Laid-open Publication No. 09-161124 discloses a money change machine of the type provided in the front area.

However, as described above, the money is managed by the money processing unit in the backyard area during the nighttime, and the money is left only in the money processing unit. Therefore, it is only necessary for a robber who invades in the store to raid the one place of the money processing unit in the backyard area, and there is a risk that the robber robs the money from the money processing unit before the security guard of the security company arrives at the store. Conventionally, as described above, after the business hours, the money is collected from the money change machine provided in the front area, and stored in the money processing unit provided in the backyard area. Additionally, before the business hours on the next day, the money (the change fund) used as the change in the money change machine in the front area is dispensed from the money processing device provided in the backyard area, and stored in the money change machine provided in the backyard area. Therefore, unfortunately the store clerk takes a lot of trouble.

SUMMARY OF THE INVENTION

In order to solve the above-described problem, an object of the present invention is to provide a banknote processing machine and a banknote processing method, in which the trouble of moving the banknotes as the change fund between the front area and the backyard area is avoidable while security is enhanced by leaving the banknotes in a plenty of places (such as the banknote processing machine provided in the front area and the money processing unit provided in the backyard area) in a dispersed manner during the nighttime.

A banknote processing machine according to the present invention comprises:

an insertion unit configured to put a banknote into the banknote processing machine;

a transport unit connected to the insertion unit and configured to transport the banknote inside the banknote processing machine;

a recognition unit provided at the transport unit and configured to recognize the banknote put into the banknote processing machine by the insertion unit;

a plurality of storing/feeding units each of which is connected to the transport unit and configured to store the banknote therein and to feed out the stored banknote;

a first cassette configured to store the banknote therein and to feed out the stored banknote;

a cassette accommodation unit connected to the transport unit and configured to detachably accommodate the first cassette; and a controller configured to control the transport unit and the storing/feeding unit, the controller selectively performing a leaving mode, in which the banknote is fed out from each of the storing/feeding units, transported to the first cassette by the transport unit, and stored and left in the first cassette, when the first cassette is accommodated in the cassette accommodation unit.

In a banknote processing machine according to one aspect of the present invention, a controller is configured to selectively perform a leaving mode when a first cassette is accommodated in a cassette accommodation unit. In the leaving mode, a banknote is fed out from each of the storing/feeding units, transported to the first cassette by the transport unit, stored the banknote in the first cassette, and left in the first cassette. When the controller performs the leaving mode, the banknote can also be left in the first cassette accommodated in the cassette accommodation unit of the banknote processing machine provided in the front area. Therefore, the trouble of moving the banknotes as the change fund between the front area and the backyard area is avoidable while the security is enhanced by leaving the banknotes in the plenty of places (such as the banknote processing machine provided in the front area and the money processing unit provided in the backyard area) in the dispersed manner during the nighttime.

In the banknote processing machine according to the present invention, the first cassette may be provided with an ink spray unit configured to spray ink toward the banknote stored in the first cassette, when a person who is not authorized to remove the banknote from the first cassette removes the banknote from the first cassette, or when a person who is not authorized to remove the first cassette from the cassette accommodation unit removes the first cassette from the cassette accommodation unit.

In the banknote processing machine according to the present invention, the controller may switch on and off an operation of the ink spray unit, and the controller may control the ink spray unit such that the operation of the ink spray unit is switched on when the leaving mode is performed.

The banknote processing machine according to the present invention may further comprise a remote-control operation unit configured to switch on and off an operation of the ink spray unit, wherein the operation of the ink spray unit may be switched on and off based on a command transmitted from the remote-control operation unit.

In the banknote processing machine according to the present invention, the first cassette may be provided with a shock detecting unit configured to detect that a shock was applied to the first cassette, and the ink spray unit may spray the ink toward the banknote stored in the first cassette when the shock detecting unit detects that the shock was applied to the first cassette.

The banknote processing machine according to the present invention may further comprise a storage unit configured to store information on the banknote stored in the first cassette accommodated in the cassette accommodation unit.

In the banknote processing machine according to the present invention, the controller selectively may perform a replenish mode, in which, based on the information stored in the storage unit, the banknote is fed out from the first cassette accommodated in the cassette accommodation unit, transported to each of the storing/feeding units by the transport unit, and stored in the storing/feeding unit.

In the banknote processing machine according to the present invention, the first cassette may be provided with an ink spray unit configured to spray ink toward the banknote stored in the first cassette, when a person who is not authorized to remove the banknote from the first cassette removes the banknote from the first cassette, or when a person who is not authorized to remove the first cassette from the cassette accommodation unit removes the first cassette from the cassette accommodation unit, the controller may switch on and off an operation of the ink spray unit, and the controller may control the ink spray unit such that the operation of the ink spray unit is switched off when the replenish mode is performed.

In the banknote processing machine according to the present invention, a second cassette configured to store the banknote may be also detachably accommodated in the cassette accommodation unit, the controller selectively may perform a collection mode, in which the banknotes of an excess amount, which is a difference between an amount of the banknotes in the banknote processing machine and an amount of change fund, are fed out from each of the storing/feeding units, transported to the second cassette by the transport unit, and stored in the second cassette, when the second cassette is accommodated in the cassette accommodation unit; and the controller may perform the leaving mode when the first cassette is accommodated in the cassette accommodation unit after the collection mode is performed.

In the banknote processing machine according to the present invention, the first cassette may be a tape type cassette, in which the banknote is stored when a pair of tapes, between which the banknote is sandwiched, is wound around a drum, and the banknote is fed out when the pair of tapes wound around the drum is unwound from the drum.

A banknote processing method according to the present invention is a banknote processing method performed by a banknote processing machine including: a transport unit configured to transport a banknote inside the banknote processing machine; a plurality of storing/feeding units each of which is connected to the transport unit and configured to store the banknote therein and to feed out the stored banknote; a first cassette configured to store the banknote therein and to feed out the stored banknote; and a cassette accommodation unit connected to the transport unit and configured to detachably accommodate the first cassette, the banknote processing method comprising:

accommodating the first cassette in the cassette accommodation unit; and feeding out the banknote from each of the storing/feeding units, transporting the banknote to the first cassette by the transport unit, and storing and leaving the banknote in the first cassette, when the first cassette is accommodated in the cassette accommodation unit.

In a banknote processing method according to another aspect of the present invention, when the first cassette is accommodated in the cassette accommodation unit, the banknote is fed out from each of the storing/feeding units, transported to the first cassette by the transport unit, and stored and left in the first cassette. Because the banknote can also be left in the first cassette accommodated in the cassette accommodation unit of the banknote processing machine provided in the front area, the trouble of moving the banknotes as the change fund between the front area and the backyard area is avoidable while the security is enhanced by leaving the banknotes in the plenty of places (such as the banknote processing machine provided in the front area and the money processing unit provided in the backyard area) in the dispersed manner during the nighttime.

In the banknote processing method according to the present invention, a second cassette configured to store the banknote may be also detachably accommodated in the cassette accommodation unit, the banknote processing method may further comprise:

accommodating the second cassette in the cassette accommodation unit; and feeding out the banknotes of an excess amount, which is a difference between an amount of the banknotes in the banknote processing machine and an amount of change fund, from each of the storing/feeding units, transporting the banknotes of the excess amount to the second cassette by the transport unit, and storing the banknotes of the excess amount in the second cassette, when the second cassette is accommodated in the cassette accommodation unit, wherein the second cassette may be taken out from the cassette accommodation unit after the banknotes of the excess amount are stored in the second cassette, then the first cassette is accommodated in the cassette accommodation unit, and the banknotes of change fund are stored and left in the first cassette.

According to the banknote processing machine and the banknote processing method, it is possible to enhance the security and to avoid the trouble of moving the banknotes as the change fund between the front area and the backyard area, by leaving the banknotes in a plenty of places (such as the banknote processing machine provided in the front area and the money processing unit provided in the backyard area) in a dispersed manner during the nighttime.

DETAILED DESCRIPTION OF THE INVENTION

Figure 1:
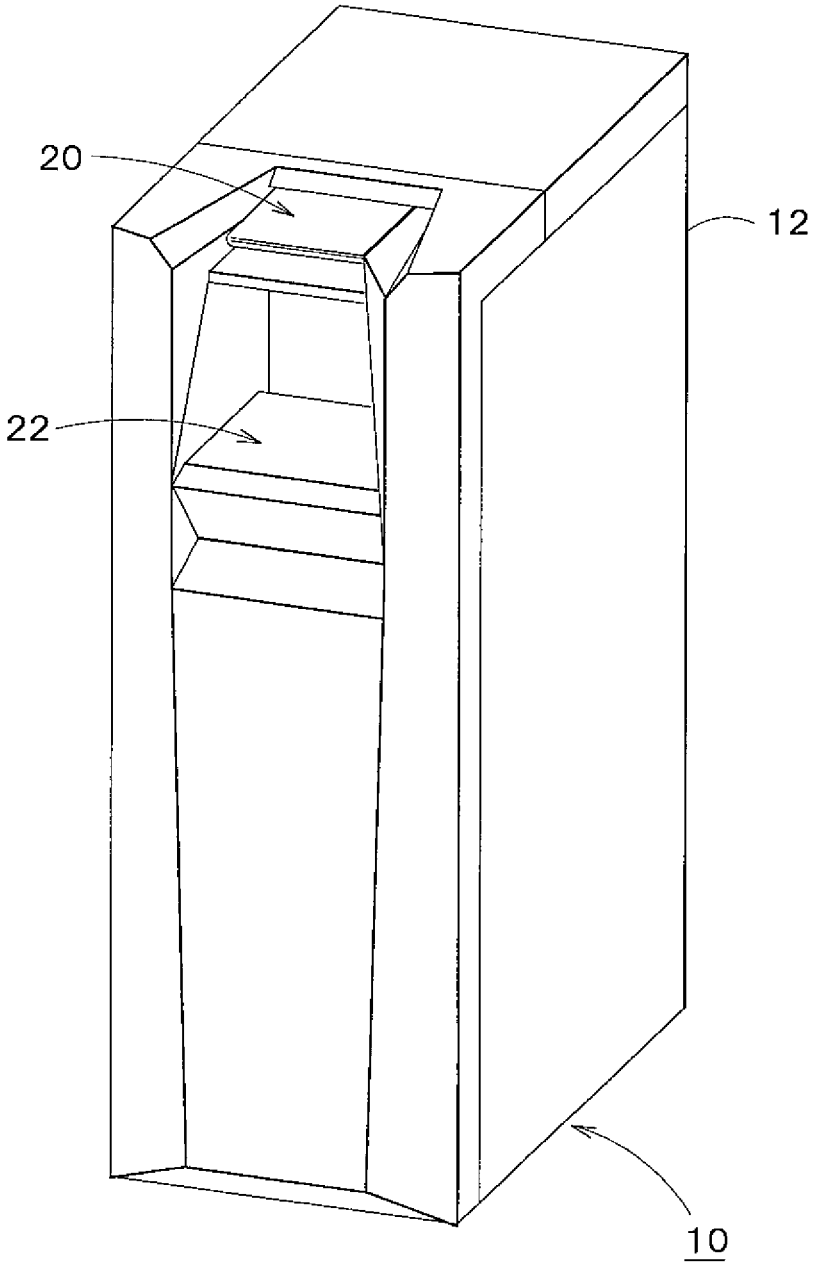
FIG. 1 is a perspective view illustrating an appearance of a banknote processing machine according to an embodiment of the present invention.
Figure 2:
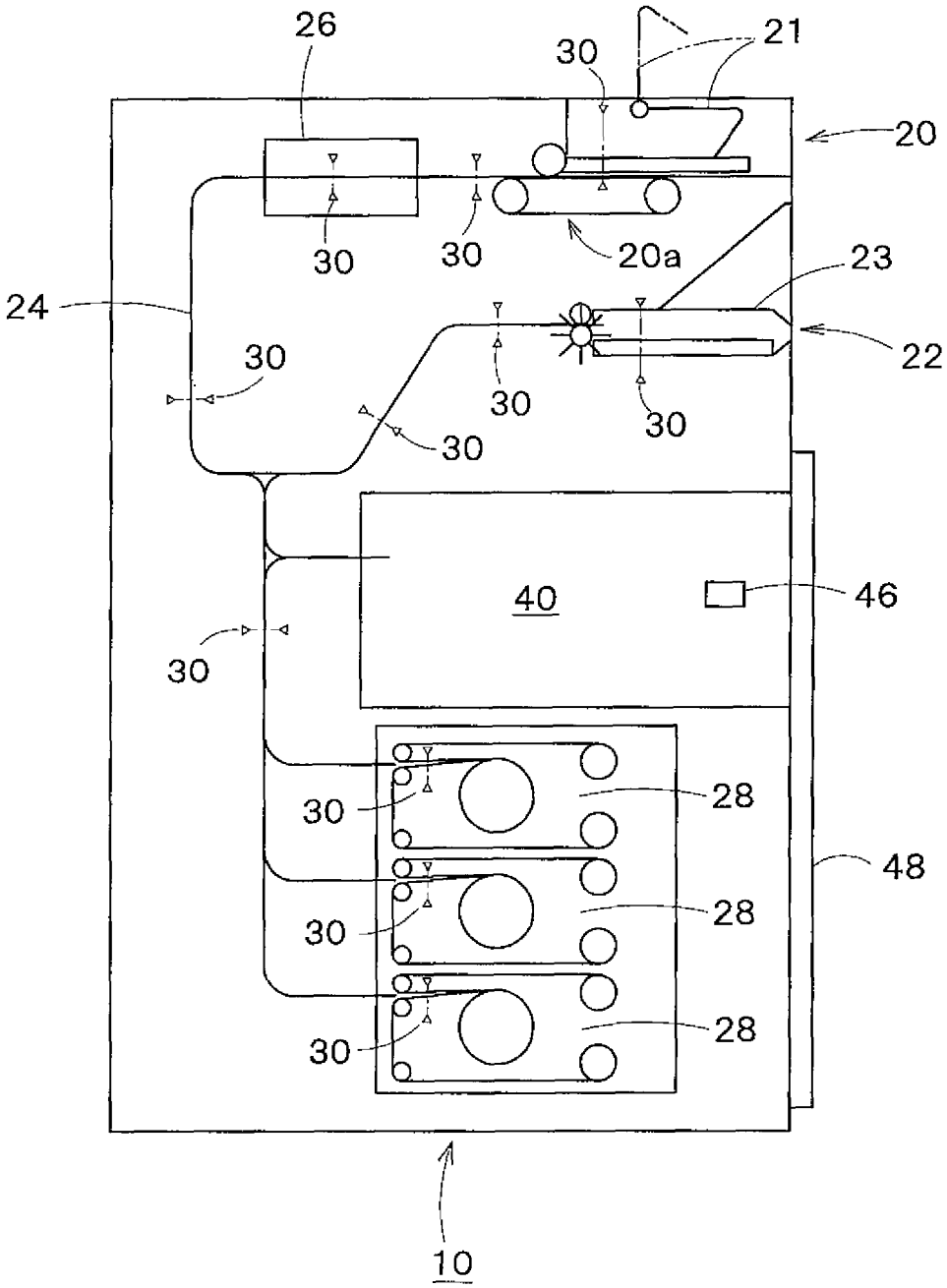
FIG. 2 is a side view illustrating an internal configuration of the banknote processing machine in FIG. 1.
Figure 3:
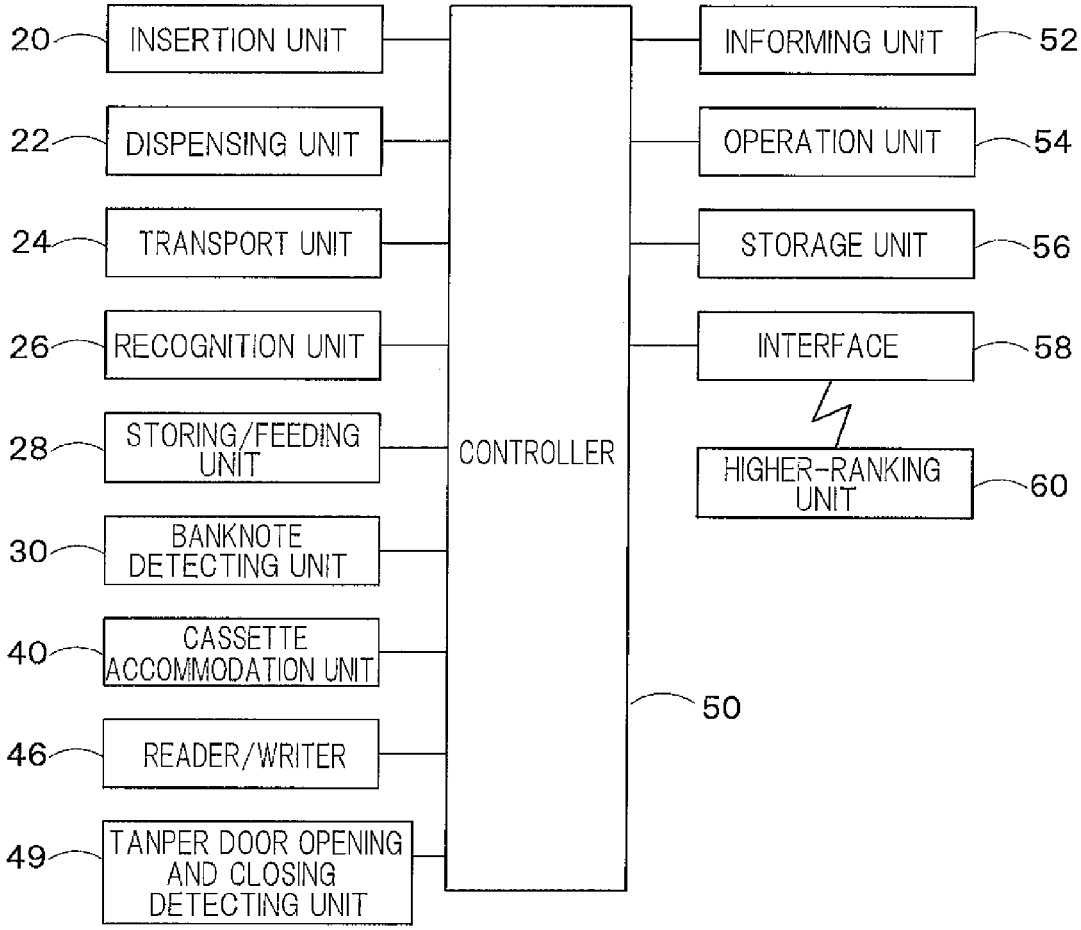
FIG. 3 is a functional block diagram of the banknote processing machine in FIGS. 1 and 2.
Figure 4:
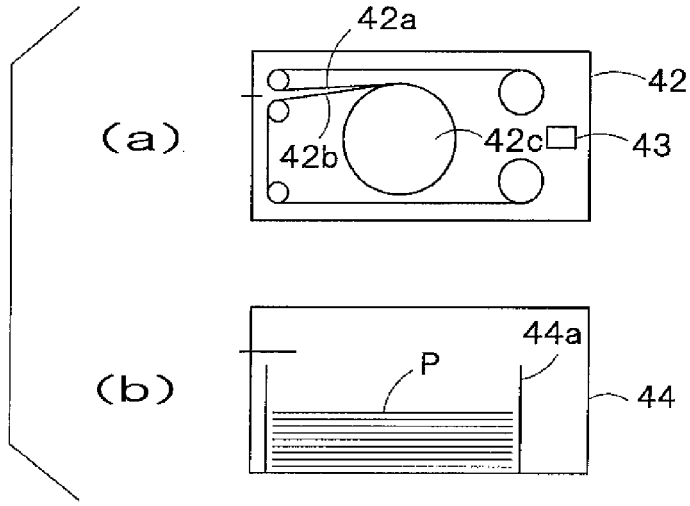
FIG. 4(*a*) is a configuration diagram of a recycle cassette, and FIG. 4(*b*) is a configuration diagram of a collection cassette.
Figure 5:
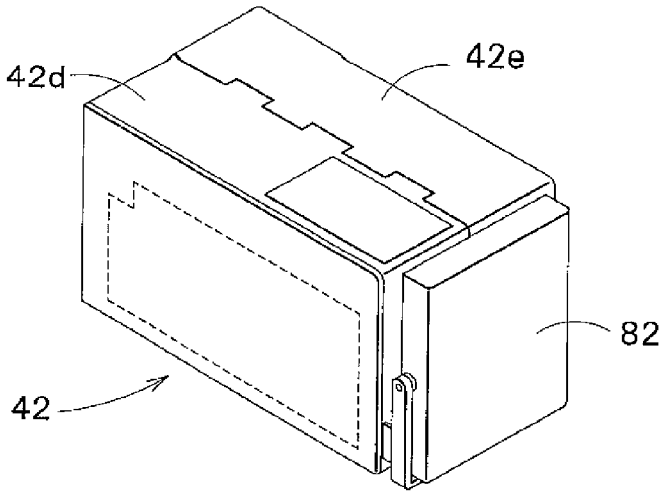
FIG. 5 is a perspective view illustrating the appearance of the recycle cassette.
Figure 6:
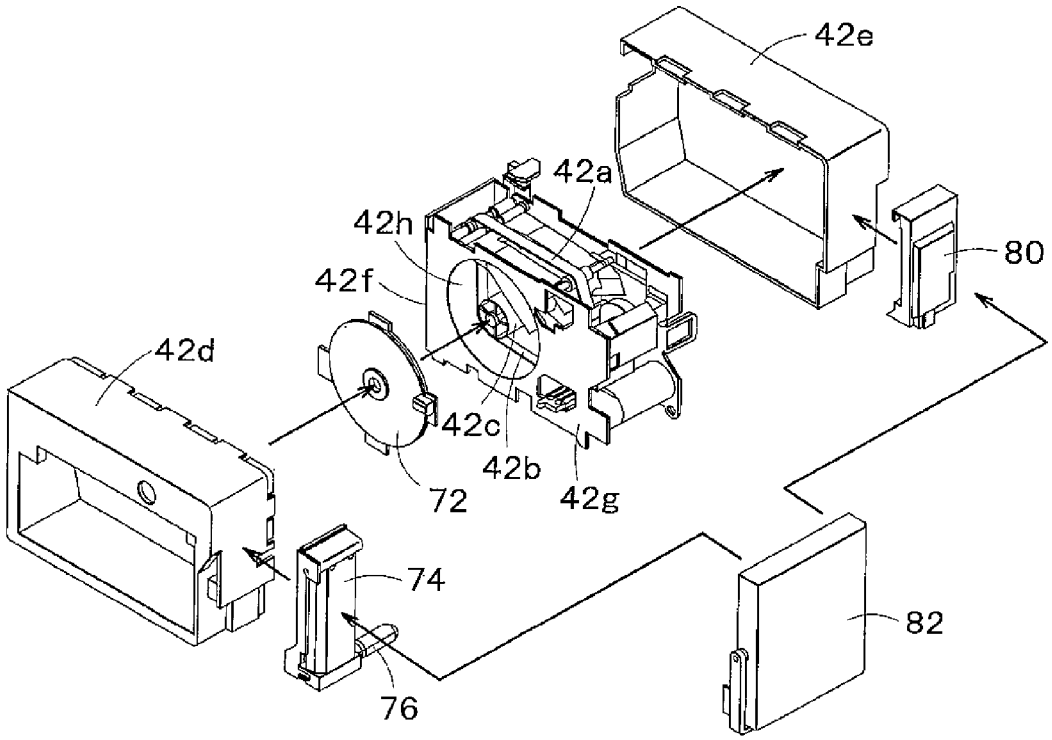
FIG. 6 is an exploded perspective view of the recycle cassette in FIG. 5.
Figure 7:
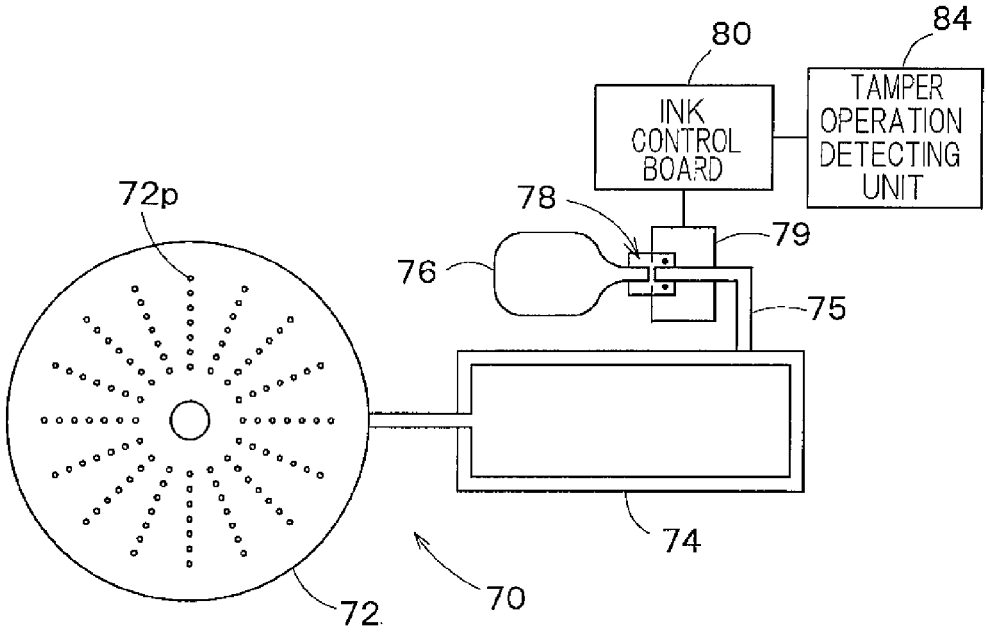
FIG. 7 is a schematic diagram illustrating a configuration of an ink spray unit provided in the recycle cassette in FIG. 5.
Figure 8:
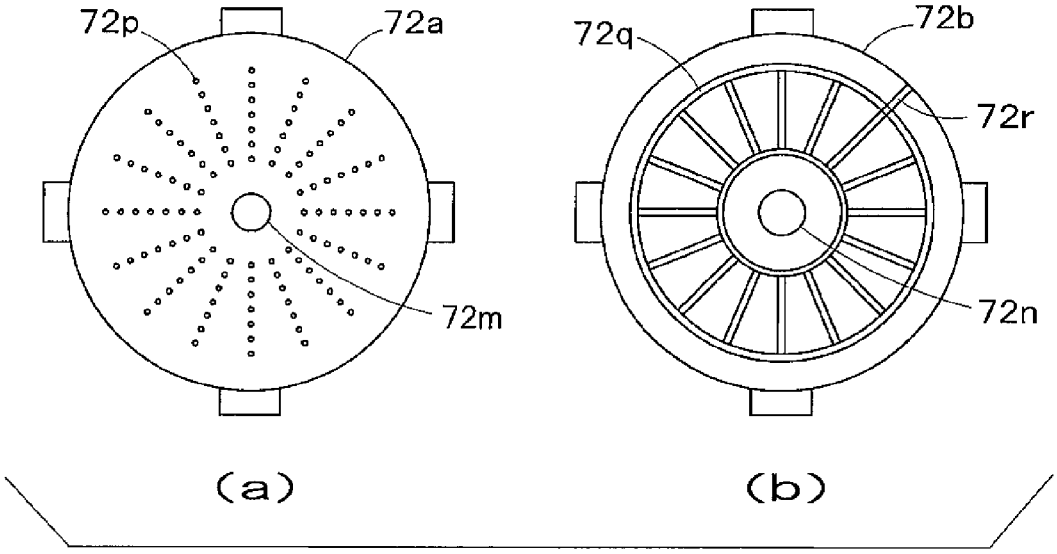
FIGS. 8(*a*) and 8(*b*) are views illustrating a configuration of an ink spraying member of the ink spray unit in FIG. 7.
Figure 9:
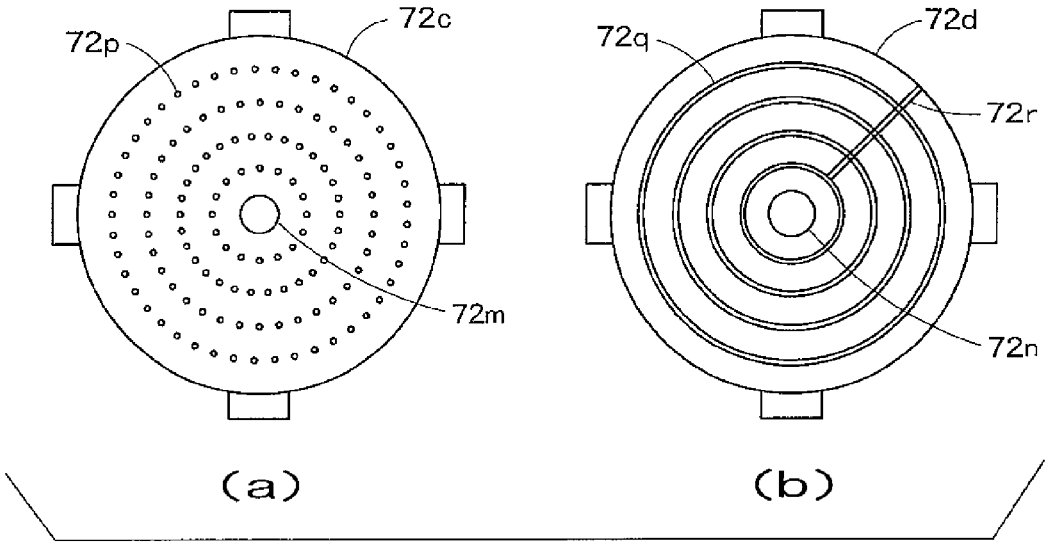
FIGS. 9(*a*) and 9(*b*) are views illustrating another configuration of the ink spraying member of the ink spray unit in FIG. 7.
Figure 10:
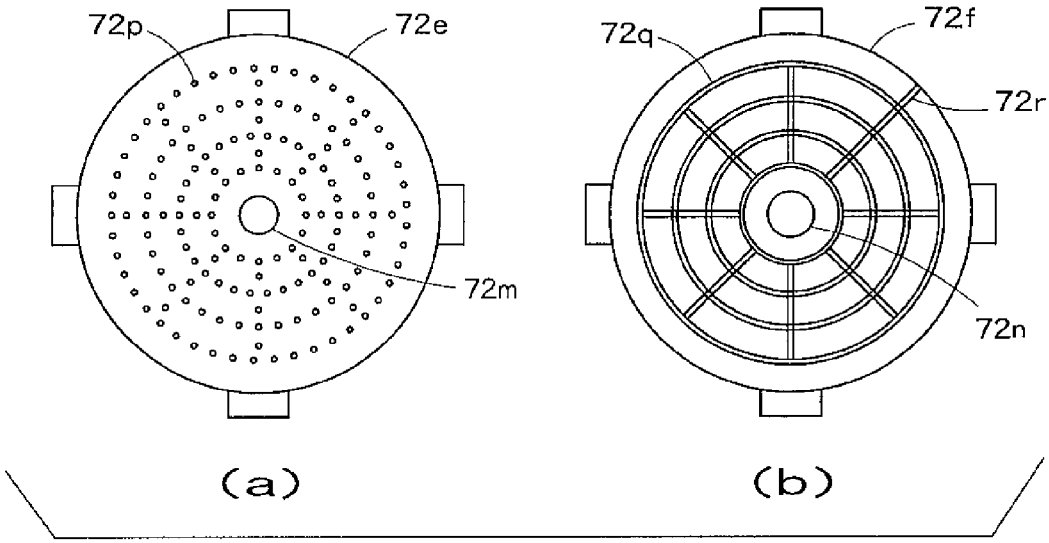
FIGS. 10(*a*) and 10(*b*) are views illustrating still another configuration of the ink spraying member of the ink spray unit in FIG. 7.

Hereafter, a banknote processing machine and a banknote processing method according to an embodiment of the present invention will be described more specifically with reference to the drawings. FIGS. 1 to 10 are views illustrating the banknote processing machine and the banknote processing method of the embodiment. FIG. 1 is a perspective view illustrating an appearance of the banknote processing machine of the embodiment, and FIG. 2 is a side view illustrating an internal configuration of the banknote processing machine in FIG. 1. FIG. 3 is a functional block diagram of the banknote processing machine in FIGS. 1 and 2. FIG. 4(*a*) is a configuration diagram illustrating a recycle cassette, and FIG. 4(*b*) is a configuration of a collection cassette. FIG. 5 is a perspective view illustrating the appearance of the recycle cassette, and FIG. 6 is an exploded perspective view of the recycle cassette in FIG. 5. FIG. 7 is a schematic configuration diagram of an ink spray unit provided in the recycle cassette in FIG. 5. FIGS. 8 to 10 are configuration diagrams illustrating various configurations of an ink spraying member of the ink spray unit in FIG. 7.

A banknote processing machine 10 of the embodiment includes a banknote change machine provided in a front area where a store clerk actually exchanges cash with a customer in a store. The banknote processing machine 10 is communicably connected to a POS register (not illustrated) which is operated by the store clerk, and processes a banknote received as a payment for a purchase from the customer and the banknote paid as change to the customer.

As illustrated in FIG. 1, the banknote processing machine 10 includes a housing 12, an insertion unit 20 that puts the banknotes into the housing 12, and a dispensing unit 22 that dispenses the banknotes to the outside of the housing 12. The insertion unit 20 includes an inlet through which the separate banknotes are put into the housing 12 from the outside. The dispensing unit 22 includes an outlet through which the separate banknotes are dispensed to the outside of the housing 12 from the inside.

As illustrated in FIG. 2, an insertion unit cover 21 is provided in the insertion unit 20. A gap exists below the insertion unit cover 21, and a small number of banknotes can be put in even if the insertion unit cover 21 is closed. On the other hand, in the case that a large number of banknotes are put in, an operator opens the insertion unit cover 21 to put the banknotes to the insertion unit 20. A feeding mechanism 20*a* is provided in the insertion unit 20, and feeds out the banknotes put in the insertion unit 20 to a transport unit 24, which will be described later, one by one.

A dispensing unit shutter 23 is also provided in the dispensing unit 22. The dispensing unit shutter 23 usually closes the outlet of the dispensing unit 22. When a desired number of banknotes are transported to the dispensing unit 22 from the transport unit 24 in dispensing the banknotes, the dispensing unit shutter 23 opens, and the operator can remove the banknotes stacked on the dispensing unit 22.

As illustrated in FIG. 2, the transport unit 24 is provided in the housing 12 of the banknote processing machine 10, and transports the banknotes put into the housing 12 by the insertion unit 20 in the housing 12 one by one. A recognition unit 26 is provided in the transport unit 24, and recognizes denomination, authenticity, fitness, and a version of paper sheet of the banknotes transported by the transport unit 24.

A plenty of storing/feeding units 28 are provided in the housing 12, and each of the storing/feeding units 28 is connected to the transport unit 24. The banknote, which is put into the housing 12 by the insertion unit 20 and recognized by the recognition unit 26, is stored in each storing/feeding unit 28 by denomination. More particularly, the transport unit 24 transports the banknote to each storing/feeding unit 28 by denomination based on a recognition result of the recognition unit 26. Each storing/feeding unit 28 can feed the banknotes stored therein to the transport unit 24 one by one. Each storing/feeding unit 28 may be a tape type storing/feeding unit in which a pair of tapes, which sandwiches each banknote, is wound together with the banknotes as illustrated in FIG. 2, or a stacker type storing/feeding unit (not illustrated) in which the banknotes are stored while stacked on one another.

As illustrated in FIG. 2, a cassette accommodation unit 40 is provided in the housing 12. One of a recycle cassette (first cassette) 42 and a collection cassette (second cassette) 44 in FIG. 4 is detachably accommodated in the cassette accommodation unit 40. The recycle cassette 42 and the collection cassette 44 can selectively be accommodated in the identical space (specifically, the cassette accommodation unit 40) of the banknote processing machine 10.

As illustrated in FIG. 4(*a*), the recycle cassette 42 is the tape type cassette in which a pair of tapes 42*a* and 42*b*, which sandwiches each banknote, is wound together with the banknotes by a drum 42*c*. When the recycle cassette 42 is mounted on the cassette accommodation unit 40, the banknotes transported to the recycle cassette 42 from the transport unit of the banknote processing machine 10 is sandwiched between the pair of tapes 42*a* and 42*b*, and wound together with the pair of tapes 42*a* and 42*b* by the drum 42*c*. Thus, the banknotes stored in the recycle cassette 42 are not allowed to be taken out from the outside unless the recycle cassette 42 is mounted on the cassette accommodation unit 40 of the banknote processing machine 10. A cover (not illustrated) is provided in a banknote inlet and outlet of the recycle cassette 42 in order to prevent such a tamper access to force the banknote inlet and outlet open and to remove the banknotes. The use of the recycle cassette 42 having the configuration in FIG. 4(*a*) prevents the operator from touching the banknotes therein.

A storage unit 43, such as an IC tag, is provided in the recycle cassette 42. A reader/writer 46 is provided in the cassette accommodation unit 40 of the banknote processing machine 10. For example, the reader/writer 46 reads and writes information from and in the storage unit 43 of the recycle cassette 42 mounted on the cassette accommodation unit 40 by a non-contact manner or electric communication. A detailed content of the information stored in the storage unit 43 is described later.

As illustrated in FIG. 4(*b*), for example, the collection cassette 44 includes the stacker type unit. A stacking unit 44*a* is provided in the collection cassette 44, and the plenty of banknotes (designated by the reference numeral P in FIG. 4(*b*)) are stacked in a laminated state in the stacking unit 44*a*. When the collection cassette 44 is mounted on the cassette accommodation unit 40, the banknotes transported to the collection cassette 44 from the transport unit 24 of the banknote processing machine 10 are stacked in the laminated state in the stacking unit 44*a*. The collection cassette 44 is mounted on the cassette accommodation unit 40 during the business hours of the store. For example, the overflow banknotes, which cannot be stored in each storing/feeding unit although is put into the housing 12 of the banknote processing machine 10, or the banknotes, which are not set so as to be stored in each storing/feeding unit 28, is transported to the collection cassette 44 by the transport unit 24, and stored in the collection cassette 44. During the business hours of the store, the recycle cassette 42, in place of the collection cassette 44, may be mounted on the cassette accommodation unit 40.

As illustrated in FIG. 2, banknote detecting sensors 30 are provided in respective transport paths of the insertion unit 20, the dispensing unit 22, and the transport unit 24 and in the storing/feeding units 28. The existence or non-existence of the banknote and passage of the transported banknote are detected by the banknote detecting sensors 30.

As illustrated in FIG. 2, a door 48 is provided in a rear surface of the housing 12 of the banknote processing machine 10. By opening the door 48, the recycle cassette 42 or the collection cassette 44 can be accommodated in the cassette accommodation unit 40, or the recycle cassette 42 or the collection cassette 44 can be taken out from the cassette accommodation unit 40. An tamper door opening and closing detecting unit 49 (see FIG. 3) is provided in the door 48, and the tamper door opening and closing detecting unit 49 detects the opening of the door 48 when a person who is not authorized to remove the recycle cassette 42 or the collection cassette 44 from cassette accommodation unit 40 opens the door 48.

As illustrated in FIG. 3, a controller 50 is provided in the banknote processing machine 10, and controls various components of the banknote processing machine 10. More specifically, the insertion unit 20, the dispensing unit 22, the transport unit 24, the recognition unit 26, the storing/feeding unit 28, the banknote detecting sensor 30, the cassette accommodation unit 40, the reader/writer 46, and the tamper door opening and closing detecting unit 49 are connected to the controller 50. At this point, information on the banknote recognition result of the recognition unit 26 and information on the banknote detected by the banknote detecting sensor 30 are transmitted to the controller 50. When the recycle cassette 42 is accommodated in the cassette accommodation unit 40, the controller 50 is allowed to control the recycle cassette 42 accommodated in the cassette accommodation unit 40. At this point, the information, which is read by the reader/writer 46 and stored in the storage unit 43, is transmitted to the controller 50 when the recycle cassette 42 is accommodated in the cassette accommodation unit 40. When the tamper door opening and closing detecting unit 49 detects that the person who is not authorized to remove the recycle cassette 42 or the collection cassette 44 from the cassette accommodation unit 40 opens the door 48, the detection information is transmitted to the controller 50. The controller 50 transmits a control signal to the insertion unit 20, the dispensing unit 22, the transport unit 24, and the storing/feeding unit 28 to control these components.

The informing unit 52, the operation unit 54, the storage unit 56, and the interface 58 are connected to the controller 50. The controller 50 is adapted to transmit and receive a signal to and from a higher-ranking unit 60, more specifically such as a POS system, through an interface 58. An informing unit 52 informs the operator of various pieces of information using sound and display, for example. Specifically, the informing unit 52 includes, for example, a monitor provided in a front surface or an upper surface of the housing 12 of the banknote processing machine 10. The informing unit 52 may be provided in the higher-ranking unit 60 which is connected through communication with the banknote processing machine 10. An operation unit 54 is used when the operator issues various commands to the controller 50. Specifically, for example, the operation unit 54 includes a touch panel or an operation key, which is provided in a front surface or an upper surface of the housing 12 of the banknote processing machine 10. The operation unit 54 may be provided in the higher-ranking unit 60 which is connected through communication with the banknote processing machine 10. A processing status of the banknotes inside the banknote processing machine 10 is stored in a storage unit 56. Specifically, for example, the number and amount of banknotes stored in each storing/feeding unit 28 by denomination are stored in the storage unit 56. The number and amount of banknotes to be replenished as the change fund in the banknote processing machine 10 by denomination, or the total amount of banknotes, are also previously stored in the storage unit 56.

The detailed configuration of the recycle cassette 42 of the embodiment will be described below. In the embodiment, an ink spray unit 70 is provided in the recycle cassette 42. The ink spray unit 70 sprays the ink toward the banknotes stored in the recycle cassette 42, when the person who is not authorized to remove the banknotes from the recycle cassette 42 removes the banknotes from the recycle cassette 42, or when the person who is not authorized to remove the recycle cassette 42 from the cassette accommodation unit 40 removes the recycle cassette 42 from the cassette accommodation unit 40. The configuration of the ink spray unit 70 will specifically be described with reference to FIGS. 5 to 10. FIG. 5 is a perspective view illustrating the appearance of the recycle cassette 42, and FIG. 6 is an exploded perspective view of the recycle cassette 42 in FIG. 5. FIG. 7 is a schematic configuration diagram of the ink spray unit 70 provided in the recycle cassette 42 in FIG. 5. FIGS. 8 to 10 are configuration diagrams illustrating various configurations of the ink spraying member 72 of the ink spray unit 70 in FIG. 7.

As illustrated in FIGS. 5 and 6, the recycle cassette 42 includes a pair of cassette covers 42*d* and 42*e*, and a tape type storing/feeding unit 42*f* in FIG. 6 is accommodated between the cassette covers 42*d* and 42*e*. The storing/feeding unit 42*f* includes the pair of tapes 42*a* and 42*b* and the drum 42*c* illustrated in FIG. 4(*a*). The storing/feeding unit 42*f* stores the banknotes in a step where the pair of tapes 42*a* and 42*b*, which sandwiches banknotes, is wound by the drum 42*c*, and the storing/feeding unit 42*f* feeds out the banknotes in a step where the pair of tapes 42*a* and 42*b* wound by the drum 42*c* is unwound from the drum 42*c*.

As illustrated in FIGS. 6 and 7, the ink spray unit 70 that sprays the ink toward the banknotes stored in the storing/feeding unit 42*f* of the recycle cassette 42 includes a disc-shape ink spraying member 72, an ink reservoir (ink tank) 74, a compressed gas reservoir 76, and an ink control board 80. As illustrated in FIG. 6, the disc-shape ink spraying member 72 is disposed in one of side surfaces of the storing/feeding unit 42*f*. Although not illustrated, the disc-shape ink spraying members 72 may be disposed in both the side surfaces of the storing/feeding unit 42*f*. The detailed configuration of the disc-shape ink spraying member 72 is described later. The ink is reserved in the ink reservoir 74, and the ink reserved in the ink reservoir 74 is supplied to the ink spraying member 72. The compressed gas reservoir 76 is connected to the ink reservoir 74 through a gas pipe 75, and a compressed gas is reserved in the compressed gas reservoir 76. At this point, as illustrated in FIG. 7, a shielding portion 78 is provided in the gas pipe 75, and prevents the ink reservoir 74 and the compressed gas reservoir 76 from communicating with each other. On the other hand, a circuit 79 is provided near the shielding portion 78 in order to destroy the shielding portion 78, and the ink control board 80 is connected to the circuit 79. In the case that the ink is sprayed toward the banknotes stored in the storing/feeding unit 42*f* of the recycle cassette 42, the ink control board 80 passes a current through the circuit 79 to destroy the shielding portion 78. Consequently, the ink reservoir 74 and the compressed gas reservoir 76 communicate with each other, and the ink reserved in the ink reservoir 74 is supplied to the ink spraying member 72 by a pressure of the compressed gas reserved in the compressed gas reservoir 76. Thus, the ink is sprayed toward the side surface of the storing/feeding unit 42*f* from the ink spraying member 72, and the banknotes stored in the storing/feeding unit 42*f* is stained with the ink. As illustrated in FIG. 6, the ink reservoir 74, the compressed gas reservoir 76, and the ink control board 80 are accommodated in an ink cover 82. The ink cover 82 in which the ink reservoir 74, the compressed gas reservoir 76, and the ink control board 80 are accommodated is attached to the side surfaces of the pair of cassette covers 42*d* and 42*e* when the pair of cassette covers 42*d* and 42*e* are assembled.

The configuration of the ink spraying member 72 will be described with reference to FIG. 8. The ink spraying member 72 includes a first disc member 72*a* and a second disc member 72*b*. The first disc member 72*a* and the second disc member 72*b* have the substantially identical shape, and are joined to each other to constitute the ink spraying member 72. At this point, many ink spraying ports 72*p* are provided in the first disc member 72*a*. On the other hand, a groove 72*q* through which the ink flows is provided in the second disc member 72*b*. At this point, the groove 72*q* formed in the second disc member 72*b* faces the joined surface when the first disc member 72*a* and the second disc member 72*b* are joined to each other. That is, the groove 72*q* formed in the second disc member 72*b* passes in the ink spraying member 72 when the first disc member 72*a* and the second disc member 72*b* are joined to each other. In other words, the first disc member 72*a* serves as a cover for the groove 72*q* formed in the second disc member 72*b* when the first disc member 72*a* and the second disc member 72*b* are joined to each other.

As illustrated in FIG. 8(*b*), an ink inlet 72*r* is provided in the second disc member 72*b* so as to communicate with the groove 72*q*, and the ink supplied from the ink reservoir 74 flows in the groove 72*q* through the ink inlet 72*r*. The ink spraying ports 72*p* of the first disc member 72*a* face the side of the storing/feeding unit 42*f* when the first disc member 72*a* and the second disc member 72*b* are joined to each other. The ink spraying ports 72*p* are disposed along the groove 72*q* formed in the second disc member 72*b* when the first disc member 72*a* and the second disc member 72*b* are joined to each other. Therefore, the ink supplied to the ink spraying member 72 from the ink reservoir 74 is sprayed from the ink spraying ports 72*p* through the groove 72*q*.

Apertures 72*m* and 72*n* are formed in center portions of the first disc member 72*a* and the second disc member 72*b* in FIG. 8, respectively. As illustrated in FIG. 6, in the recycle cassette 42, a circular opening 42*h* is provided in the side surface of a cover 42*g* of the storing/feeding unit 42*f*, and the ink spraying member 72 including the first disc member 72*a* and the second disc member 72*b* is fitted in the opening 42*h*. The ink spraying member 72 constitutes a part of the cover 42*g* covering the drum 42*c* of the storing/feeding unit 42*f*. An axis of the drum 42*c* of the storing/feeding unit 42*f* is received by a housing (specifically, the circular opening 42*h* for loosing the drum 42*c* in FIG. 6) of the storing/feeding unit 42*f*, and the axis of the drum 42*c* passes through the apertures 72*m* and 72*n* of the first disc member 72*a* and the second disc member 72*b* such that the apertures 72*m* and 72*n* loose the axis. The axis of the drum 42*c* of the storing/feeding unit 42*f* may be received by the apertures 72*m* and 72*n* of the first disc member 72*a* and the second disc member 72*b* instead of the housing (the circular opening 42*h*) of the storing/feeding unit 42*f*.

In the first disc member 72*a* and the second disc member 72*b* in FIG. 8, the grooves 72*q* formed in the second disc member 72*b* are disposed so as to extend radially from the axis of the drum 42*c* of the storing/feeding unit 42*f*. Therefore, the plenty of ink spraying ports 72*p* formed in the first disc member 72*a* are disposed so as to extend radially from the axis of the drum 42*c* of the storing/feeding unit 42*f*. In the disposition of the ink spraying ports 72*p*, it is possible to spray the ink evenly to all the banknotes stored in the storing/feeding unit 42*f*.

The first and second disc members constituting the ink spraying member 72 is not limited to the first and second disc members in FIG. 8. Another example of the first and second disc members constituting the ink spraying member 72 will be described with reference to FIGS. 9 and 10.

In a first disc member 72*c* and a second disc member 72*d* in FIG. 9, the groove 72*q* formed in the second disc member 72*d* is disposed so as to extend along each of a plenty of concentric circles about the axis of the drum 42*c* of the storing/feeding unit 42*f*. Therefore, the ink spraying ports 72*p* formed in the first disc member 72*c* are disposed so as to extend along each of the concentric circles about the axis of the drum 42*c* of the storing/feeding unit 42*f*. In the disposition of the ink spraying ports 72*p* in FIG. 9(*a*), it is possible to spay the ink evenly to all the banknotes stored in the storing/feeding unit 42*f*.

In a first disc member 72*e* and a second disc member 72*f* illustrated in FIG. 10, the grooves 72*q* are formed in the second disc member 72*f* by combining the grooves 72*q* that are disposed so as to extend radially from the axis of the drum 42*c* of the storing/feeding unit 42*f* and the grooves 72*q* that are disposed so as to extend along each of the concentric circles about the axis of the drum 42*c* of the storing/feeding unit 42*f*. Therefore, the ink spraying ports 72*p* are formed in the first disc member 72*e* by combining the ink spraying ports 72*p* that are disposed so as to extend radially from the axis of the drum 42*c* of the storing/feeding unit 42*f* and the ink spraying ports 72*p* that are disposed so as to extend along each of the concentric circles about the axis of the drum 42*c* of the storing/feeding unit 42*f*. In the disposition of the ink spraying ports 72*p* in FIG. 10(*a*), it is possible to spray the ink evenly to all the banknotes stored in the storing/feeding unit 42*f*.

As illustrated in FIG. 7, in the ink spray unit 70, a tamper operation detecting unit 84 is connected to the ink control board 80. The tamper operation detecting unit 84 detects a tamper operation when the person who is not authorized to remove the banknotes from the recycle cassette 42 removes the banknotes from the recycle cassette 42. More particularly, the tamper operation detecting unit 84 is one of a cassette cover opening and closing detecting sensor (not illustrated) that detects the opening and closing of the cassette covers 42*d* and 42*e* of the recycle cassette 42, a shock detecting sensor (not illustrated) that detects a shock applied to the recycle cassette 42, a detachment detecting sensor (not illustrated) that detects detaching of the ink reservoir 74 or the ink spraying member 72 from the recycle cassette 42, and a banknote inlet and outlet forcing open detecting sensor (not illustrated) that detects forcing open of the banknote inlet and outlet of the recycle cassette 42. When the tamper operation detecting unit 84 detects the tamper operation, the ink control board 80 passes the current through the circuit 79 in order to destroy the shielding portion 78 provided in the gas pipe 75. Consequently, the ink reservoir 74 and the compressed gas reservoir 76 communicate with each other, and the ink reserved in the ink reservoir 74 is supplied to the ink spraying member 72 by the pressure of the compressed gas reserved in the compressed gas reservoir 76. Thus, the ink reserved in the ink reservoir 74 is sprayed toward edges of the banknotes stored in the storing/feeding unit 42*f* through the ink spraying ports 72*p* of the ink spraying member 72.

The ink control board 80 of the recycle cassette 42 is connected to the controller 50 of the banknote processing machine 10 when the recycle cassette 42 is accommodated in the cassette accommodation unit 40 of the banknote processing machine 10. When the person who is not authorized to remove the recycle cassette 42 from the cassette accommodation unit takes the recycle cassette 42 from the cassette accommodation unit 40, the tamper door opening and closing detecting unit 49 detects that the door 48 is unrightfully opened, and the information is transmitted to the ink control board 80 from the controller 50, whereby the ink control board 80 passes the current through the circuit 79 so as to destroy the shielding portion 78 provided in the gas pipe 75. Thus, the ink reserved in the ink reservoir 74 is sprayed toward edges of the banknotes stored in the storing/feeding unit 42*f* through the ink spraying ports 72*p* of the ink spraying member 72.

Next, an operation of the banknote processing machine 10 having the above configuration will be described below. The following operation of the banknote processing machine 10 is performed in a manner such that the controller 50 controls each component of the banknote processing machine 10.

The following "collection mode", "leaving mode", "replenish mode", and "collection/leaving mode" is allowed to be performed in the banknote processing machine 10 of the embodiment. Each mode will be described below.

(Collection Mode)

The controller 50 performs the collection mode when the banknotes which are proceeds from sales are collected from the banknote processing machine 10 after the business hours of the store. When the controller 50 performs the collection mode, the collection cassette 44 illustrated in FIG. 4(*b*) is accommodated in the cassette accommodation unit 40, in advance. The banknotes of an excess amount, which is a difference between an amount of the banknotes in the banknote processing machine 10, namely, the amount of banknotes stored in each storing/feeding unit 28 and an amount predetermined as the change fund, is fed out from each storing/feeding unit 28, transported to the collection cassette 44 by the transport unit 24, and stored in the collection cassette 44. At this point, the "amount predetermined as the change fund" is stored in the storage unit 56, in advance. Then the collection cassette 44 is detached from the cassette accommodation unit 40, and the banknotes are collected together with the collection cassette 44. The collected banknotes are stored in the money processing unit (not illustrated) or the like provided in the backyard area of the store. The collection mode, in which the banknotes that are the proceeds from sales are collected from the banknote processing machine 10, may be performed by the recycle cassette 42 in place of the collection cassette 44.

(Leaving Mode)

The collection cassette 44 is taken out from the cassette accommodation unit 40 after the controller 50 performs the collection mode to store the banknotes of the excess amount (that is, the banknotes of the difference between the amount of the banknotes in the banknote processing machine 10 and the amount of the change fund) in the collection cassette 44. After the recycle cassette 42 is accommodated in the cassette accommodation unit 40, the controller 50 performs the leaving mode as described below. When the controller 50 performs the leaving mode, each storing/feeding unit 28 feeds out the banknotes to the transport unit 24 one by one, and the transport unit 24 transports the banknotes to the recycle cassette 42 accommodated in the cassette accommodation unit 40 one by one. At this point, because the banknotes of the amount predetermined as the change fund are stored in each storing/feeding unit 28 before the leaving mode is performed, the banknotes of the amount predetermined as the change fund are stored in the recycle cassette 42 when the controller 50 performs the leaving mode. In storing the banknotes in the recycle cassette 42, the order of the banknotes wound by the drum 42*c* and the information on the denomination are stored in the storage unit 56 of the banknote processing machine 10 or the storage unit 43 of the recycle cassette 42.

(Replenish Mode)

After the controller 50 performs the collection mode and the leaving mode after the business hours of the store, the controller 50 performs the replenish mode, as described below, before the business hours on the next day. The banknotes of the amount predetermined as the change fund are stored in the recycle cassette 42 when the controller 50 performs the leaving mode. The banknotes that are the change fund are returned to each storing/feeding unit 28 from the recycle cassette 42 when the controller 50 performs the replenish mode. That is, when the controller 50 performs the replenish mode, based on the order of the banknotes wound by the drum 42*c* of the recycle cassette 42 and the information on the denomination, which are stored in the storage unit 56 of the banknote processing machine 10 or the storage unit 43 of the recycle cassette 42, the banknotes are fed to the transport unit 24 from the recycle cassette 42, transported to each storing/feeding unit 28 by the transport unit 24, and stored in each storing/feeding unit 28. Thus, the banknotes that are the change fund are stored in each storing/feeding unit 28.

(Collection/Leaving Mode)

The controller 50 may perform the collection/leaving mode instead of performing the collection mode and the subsequent leaving mode. When the controller 50 performs the collection/leaving mode, the recycle cassette 42 in FIG. 4(*a*) is previously accommodated in the cassette accommodation unit 40. The banknotes of the excess amount, which is the difference between the amount of the banknotes in the banknote processing machine 10, namely, the amount of banknotes stored in each storing/feeding unit 28 and the amount predetermined as the change fund, are fed out from each storing/feeding unit 28, transported to the recycle cassette 42 by the transport unit 24, and stored in the recycle cassette 42. Then, the banknotes left in each storing/feeding unit 28 are fed to the transport unit 24 one by one while the recycle cassette 42 is accommodated in the cassette accommodation unit 40, and the transport unit 24 transports the banknotes to the recycle cassette 42 accommodated in the cassette accommodation unit 40 one by one. At this point, the "banknotes left in each storing/feeding unit 28" is the banknotes of the amount predetermined as the change fund, the banknotes of the amount predetermined as the change fund is additionally stored in the recycle cassette 42 when the above operation is performed. In storing the banknotes in the recycle cassette 42, the order of the banknotes wound by the drum 42*c* and the information on the denomination are stored in the storage unit 56 of the banknote processing machine 10 or the storage unit 43 of the recycle cassette 42.

After the controller 50 performs the collection/leaving mode after the business hours of the store, before the business hours on the next day, the controller 50 performs the replenish mode in which the banknotes which are the change fund are returned to each storing/feeding unit 28 from the recycle cassette 42. More particularly, when the controller 50 performs the replenish mode, based on the order of the banknotes wound by the drum 42*c* of the recycle cassette 42 and the information on the denomination, which are stored in the storage unit 56 of the banknote processing machine 10 or the storage unit 43 of the recycle cassette 42, the banknotes of the amount predetermined as the change fund are fed to the transport unit 24 from the recycle cassette 42, transported to each storing/feeding unit 28 by the transport unit 24, and stored in each storing/feeding unit 28. Thus, the banknotes that are the change fund are stored in each storing/feeding unit 28. In this case, the banknotes of the excess amount which is difference between the amount of the banknotes in the banknote processing machine 10 and the amount predetermined as the change fund are left in the recycle cassette 42. Therefore, the recycle cassette 42 is detached from the cassette accommodation unit 40, and the banknotes are collectable together with the recycle cassette 42. The collected banknotes are stored in the money processing unit provided in the backyard area of the store.

In the present invention, the "collection/leaving mode" is included in a concept of the "leaving mode" as a type of the "leaving mode".

In the embodiment, the controller 50 of the banknote processing machine 10 switches on and off an operation of the ink spray unit 70 of the recycle cassette 42. More particularly, the controller 50 controls the ink spray unit 70 such that the operation of the ink spray unit 70 is switched on when the leaving mode is performed. Therefore, in performing the leaving mode, the ink spray unit 70 sprays the ink toward the banknotes stored in the recycle cassette 42, when the person who is not authorized to remove the banknotes from the recycle cassette 42 removes the banknotes from the recycle cassette 42, or when the person who does not have authority to remove the recycle cassette 42 from the cassette accommodation unit 40 removes the recycle cassette 42 from the cassette accommodation unit 40. Therefore, the security of the banknotes in the recycle cassette 42 is maintainable in performing the leaving mode.

In the embodiment, the controller 50 controls the ink spray unit 70 such that the operation of the ink spray unit 70 is switched off when the replenish mode is performed. Therefore, in performing the replenish mode, the ink spray unit 70 does not spray the ink toward the banknotes stored in the recycle cassette 42. As described above, because the replenish mode is performed before the business hours of the store, the store clerk are in the store during such a time period, and accordingly it is not necessary to switch the operation of the ink spray unit 70 on. In the embodiment, the operation of the ink spray unit 70 may always be switched on during the business hours of the store In the embodiment, a remote controller or the like may be provided as the remote-control operation unit in order to switch on and off the operation of the ink spray unit 70 of the recycle cassette 42. In this case, the operation of the ink spray unit 70 is switched on and off based on the command transmitted from the remote-control operation unit, such as the remote controller, by wireless data communication such as infrared communication. More particularly, a receiver (not illustrated) that receives, for example, an infrared ray emitted from the remote-control operation unit such as the remote controller is provided in the ink control board 80. The ink control board 80 passes the current through the circuit 79 so as to destroy the shielding portion 78 provided in the gas pipe 75 when the receiver receives the infrared ray emitted from the remote-control operation unit such as the remote controller. Thus, the ink reserved in the ink reservoir 74 is sprayed toward the banknotes stored in the storing/feeding unit 42*f* through the ink spraying ports 72*p* of the ink spraying member 72.

According to the banknote processing machine 10 and the banknote processing method of the embodiment, the controller 50 selectively performs the leaving mode when the recycle cassette (first cassette) 42 is accommodated in the cassette accommodation unit 40. In the leaving mode, the banknotes are fed out from each storing/feeding unit 28, transported to the recycle cassette 42 by the transport unit 24, and stored and left in the recycle cassette 42. When the controller 50 performs the leaving mode, the banknotes are allowed to be left also in the recycle cassette 42 accommodated in the cassette accommodation unit 40 of the banknote processing machine 10 provided in the front area. Therefore, the trouble of moving the banknotes as the change fund between the front area and the backyard area is avoidable while the security is enhanced by leaving the banknotes in the plenty of places (specifically, the banknote processing machine 10 provided in the front area and the money processing unit provided in the backyard area) in the dispersed manner during the nighttime.

In the banknote processing machine 10 of the embodiment, the ink spray unit 70 sprays the ink toward the banknotes stored in the recycle cassette 42, when the person who is not authorized to remove the banknotes from the recycle cassette 42 removes the banknotes from the recycle cassette 42, or when the person who is not authorized to remove the recycle cassette 42 from the cassette accommodation unit 40 removes the recycle cassette 42 from the cassette accommodation unit 40. For example, when the banknotes are unrightfully taken out from the recycle cassette 42 in the nighttime, or when the recycle cassette 42 is unrightfully taken out from the cassette accommodation unit 40, the ink spray unit 70 sprays the ink toward the banknotes stored in the recycle cassette 42, and the tamper action becomes evident by the banknotes stained with the ink. Therefore, the security of the banknotes in the recycle cassette 42 is maintained.

In the banknote processing machine 10 of the embodiment, the information on the banknotes stored in the recycle cassette 42 accommodated in the cassette accommodation unit 40 is stored in the storage unit 56 of the banknote processing machine 10 or the storage unit 43 of the recycle cassette 42. The controller 50 performs the replenish mode based on the information stored in the storage unit 56 of the banknote processing machine 10 or the storage unit 43 of the recycle cassette 42. In the replenish mode, the banknotes are fed out from the recycle cassette 42 accommodated in the cassette accommodation unit 40, transported to each storing/feeding unit 28 by the transport unit 24, and stored in each storing/feeding unit 28. At this point, the controller 50 controls the ink spray unit 70 such that the operation of the ink spray unit 70 is switched off when the replenish mode is performed.

In the banknote processing machine 10 of the embodiment, the collection cassette (second cassette) 44, in which the banknotes are stored, is also detachably accommodated in the cassette accommodation unit 40. The controller 50 selectively performs the collection mode when the collection cassette 44 is accommodated in the cassette accommodation unit 40, and the controller 50 performs the leaving mode when recycle cassette 42 is accommodated in the cassette accommodation unit 40 after the collection mode is performed. In the collection mode, the banknotes of the excess amount, which is the difference between the amount of the banknotes in the banknote processing machine 10 and the amount of the change fund, are fed out from each storing/feeding unit 2, transported to the collection cassette 44 by the transport unit 24, and stored in the collection cassette 44.

In the banknote processing machine 10 of the embodiment, the recycle cassette 42 is the tape type cassette, in which the banknotes are stored when the pair of tapes 42*a* and 42*b*, between which the banknotes are sandwiched, is wound around the drum 42*c* and the banknotes are fed out when the pair of tapes 42*a* and 42*b* wound around the drum 42*c* is unwound from the drum 42*c*.

The tape type storing/feeding unit 42*f* and the ink spraying member 72 are provided in the recycle cassette 42 of the embodiment, and the ink spraying member 72 is disposed at least one of side surfaces of the storing/feeding unit 42*f*. The storing/feeding unit 42*f* stores the banknotes by winding the pair of tapes 42*a* and 42*b*, between which the banknotes are sandwiched, around the drum 42*c*, and feeds out the banknotes by unwinding the pair of tapes 42*a* and 42*b* wound around the drum 42*c* from the drum 42*c*. The ink spraying ports 72*p*, through which the ink reserved in the ink reservoir 74 is sprayed, are provided in the ink spraying member 72. Therefore, even if the tape type storing/feeding unit 42*f* is used, it is possible to spray the ink evenly to all the banknotes stored in the storing/feeding unit 42*f* by disposing the ink spraying member 72 in at least one of the side surfaces of the storing/feeding unit 42*f*, when the person who is not authorized to remove the banknotes from the recycle cassette 42 removes the banknotes from the recycle cassette 42.

In the recycle cassette 42 of the embodiment, in the ink spraying member 72, the plenty of ink spraying ports 72*p* are disposed along each of the plenty of concentric circles about the axis of the drum 42*c* of the storing/feeding unit 42*f* as illustrated in FIG. 9(*a*). Alternatively, in the ink spraying member 72, the plenty of ink spraying ports 72*p* may be disposed along each of the plenty of radial lines extending radially from the axis of the drum 42*c* of the storing/feeding unit 42*f* as illustrated in FIG. 8(*a*). Preferably the ink spraying member 72 has a circular shape.

In the recycle cassette 42 of the embodiment, the ink spraying member 72 is formed by joining the first disc members 72*a*, 72*c*, and 72*e*, in which the ink spraying ports 72*p* are provided, and the second disc members 72*b*, 72*d*, and 72*f*, in which the groove 72*q* in which the ink flows is provided, to each other. The apertures 72*m* and 72*n* through which the axis of the drum 42*c* of the storing/feeding unit 42*f* passes are provided in the ink spraying member 72. The ink spraying member 72 is a part of the cover 42*f* covering the drum 42*c* of the storing/feeding unit 42*f*.

The tamper operation detecting unit 84, which detects the tamper operation when the person who is not authorized to remove the banknotes from the recycle cassette 42 removes the banknotes from the recycle cassette 42, is provided in the recycle cassette 42 of the embodiment. The ink reserved in the ink reservoir 74 is sprayed toward the edges of the banknotes stored in the storing/feeding unit 42*f* through the ink spraying ports 72*p* of the ink spraying member 72 when the tamper operation detecting unit 84 detects the tamper operation.

The banknote processing machine 10 or the recycle cassette 42 is not limited to the aspects of the embodiment describe above, but various changes may be made.

For example, in the banknote processing machine 10, the recycle cassette 42 in which the ink spray unit 70 is provided is accommodated in the cassette accommodation unit 40 when the controller 50 performs the leaving mode. Alternatively, the recycle cassette 42 in which the ink spray unit 70 is not provided may be accommodated in the cassette accommodation unit 40 when the controller 50 performs the leaving mode. Even in this case, the banknotes are left in the recycle cassette 42 accommodated in the cassette accommodation unit 40 of the banknote processing machine 10 provided in the front area when the controller 50 performs the leaving mode. Therefore, the trouble of moving the banknotes as the change fund between the front area and the backyard area is avoidable while the security is enhanced by leaving the banknotes in the plenty of places (specifically, the banknote processing machine 10 provided in the front area and the money processing unit provided in the backyard area) in the dispersed manner during the nighttime.

Alternatively, the ink spray unit 70 may be provided in not only the recycle cassette 42 but also the collection cassette 44. In this case, the security of the banknotes stored in the collection cassette 44 can be enhanced.

In the description of the embodiment, the shock detecting sensor is provided in the recycle cassette 42 in order to detect the shock applied to the recycle cassette 42. The shock detecting sensor may be provided in the banknote processing machine 10 in order to detect the shock applied to the banknote processing machine 10. For example, the shock detecting sensor is provided in the door 48 of the banknote processing machine 10. As a result, the shock detecting sensor detects the shock applied to the banknote processing machine 10 when the robber forcedly opens the door 48 to remove the recycle cassette 42 from the cassette accommodation unit 40 while the recycle cassette 42 is accommodated in the cassette accommodation unit 40. The controller 50 transmits the detection information to the ink control board 80, whereby the ink spray unit 70 sprays the ink toward the banknotes stored in the recycle cassette 42. Thus, the security of the recycle cassette 42 accommodated in the cassette accommodation unit 40 of the banknote processing machine 10 can be enhanced.

10 banknote processing machine
12 housing
20 insertion unit
20*a* feeding mechanism
21 insertion unit cover
22 dispensing unit
23 dispensing unit shutter
24 transport unit
26 recognition unit
28 storing/feeding unit
30 banknote detecting sensor
40 cassette accommodation unit
42 recycle cassette
42*a*, 42*b* a pair of tapes
42*c* drum
42*d*, 42*e* a pair of cassette covers
42*f* storing/feeding unit
42*g* cover
42*h* opening

43 storage unit
44 collection cassette
46 reader/writer
48 door
49 tamper door opening and closing detecting unit
50 controller
52 informing unit
54 operation unit
56 storage unit
58 interface
60 higher-ranking unit
70 ink spray unit
72 ink spraying member
72*a*, 72*c*, 72*e* first disc member
72*b*, 72*d*, 72*f* second disc member
72*m*, 72*n* aperture
72*p* ink spraying port
72*q* groove
72*r* ink inlet
74 ink reservoir
75 gas pipe
76 compressed gas reservoir
78 shielding portion
79 circuit
80 ink control board
82 ink cover
84 tamper operation detecting unit

What is claimed is:

1. A banknote processing machine comprising:

an insertion unit configured to put a banknote into the banknote processing machine;

a transport unit connected to the insertion unit and configured to transport the banknote inside the banknote processing machine;

a recognition unit provided at the transport unit and configured to recognize the banknote put into the banknote processing machine by the insertion unit;

a plurality of storing/feeding units each of which is connected to the transport unit and configured to store the banknote therein and to feed out the stored banknote;

a first cassette connected to the transport unit and configured to store the banknote therein and to feed out the stored banknote;

an ink spray unit configured to spray ink toward the banknote stored in the first cassette; and a controller configured to control the transport unit and the storing/feeding units, the controller selectively performing a leaving mode, in which the banknote is fed out from each of the storing/feeding units, transported to the first cassette by the transport unit, and stored and left in the first cassette.

2. The banknote processing machine according to claim 1, wherein the first cassette is a tape type cassette, in which the banknote is stored when a pair of tapes, between which the banknote is sandwiched, is wound around a drum, and the banknote is fed out when the pair of tapes wound around the drum is unwound from the drum.

3. The banknote processing machine according to claim 1, further comprising:

a cassette accommodation unit configured to detachably accommodate the first cassette, wherein the controller selectively performs a leaving mode, in which the banknote is fed out from each of the storing/feeding units, transported to the first cassette by the transport unit, and stored and left in the first cassette, when the first cassette is accommodated in the cassette accommodation unit.

4. The banknote processing machine according to claim 3, wherein a second cassette configured to store the banknote is also detachably accommodated in the cassette accommodation unit, the controller selectively performs a collection mode, in which the banknotes of an excess amount, which is a difference between an amount of the banknotes in the banknote processing machine and an amount of change fund, are fed out from each of the storing/feeding units, transported to the second cassette by the transport unit, and stored in the second cassette, when the second cassette is accommodated in the cassette accommodation unit; and the controller performs the leaving mode when the first cassette is accommodated in the cassette accommodation unit after the collection mode is performed.

5. The banknote processing machine according to claim 3, wherein the ink spray unit sprays ink toward the banknote stored in the first cassette, when a person who is not authorized to remove the banknote from the first cassette removes the banknote from the first cassette, or when a person who is not authorized to remove the first cassette from the cassette accommodation unit removes the first cassette from the cassette accommodation unit.

6. The banknote processing machine according to claim 5, further comprising a remote-control operation unit configured to switch on and off an operation of the ink spray unit, wherein the operation of the ink spray unit is switched on and off based on a command transmitted from the remote-control operation unit.

7. The banknote processing machine according to claim 5, wherein the first cassette is provided with a shock detecting unit configured to detect that a shock was applied to the first cassette, and the ink spray unit sprays the ink toward the banknote stored in the first cassette when the shock detecting unit detects that the shock was applied to the first cassette.

8. The banknote processing machine according to claim 3, further comprising a storage unit configured to store information on the banknote stored in the first cassette accommodated in the cassette accommodation unit.

9. The banknote processing machine according to claim 6, wherein the controller selectively performs a replenish mode, in which, based on the information stored in the storage unit, the banknote is fed out from the first cassette accommodated in the cassette accommodation unit, transported to each of the storing/feeding units by the transport unit, and stored in the storing/feeding units.

10. The banknote processing machine according to claim 9, wherein the first cassette is provided with an ink spray unit configured to spray ink toward the banknote stored in the first cassette, when a person who is not authorized to remove the banknote from the first cassette removes the banknote from the first cassette, or when a person who is not authorized to remove the first cassette from the cassette accommodation unit removes the first cassette from the cassette accommodation unit, the controller switches on and off an operation of the ink spray unit, and the controller controls the ink spray unit such that the operation of the ink spray unit is switched off when the replenish mode is performed.

11. A banknote processing machine comprising:

an insertion unit configured to put a banknote into the banknote processing machine;

a transport unit connected to the insertion unit and configured to transport the banknote inside the banknote processing machine;

a recognition unit provided at the transport unit and configured to recognize the banknote put into the banknote processing machine by the insertion unit;

a plurality of storing/feeding units each of which is connected to the transport unit and configured to store the banknote therein and to feed out the stored banknote;

a first cassette configured to store the banknote therein and to feed out the stored banknote;

a cassette accommodation unit connected to the transport unit and configured to detachably accommodate the first cassette; and a controller configured to control the transport unit and the storing/feeding units, the controller selectively performing a leaving mode, in which the banknote is fed out from each of the storing/feeding units, transported to the first cassette by the transport unit, and stored and left in the first cassette, when the first cassette is accommodated in the cassette accommodation unit;

wherein the first cassette is provided with an ink spray unit configured to spray ink toward the banknote stored in the first cassette, when a person who is not authorized to remove the banknote from the first cassette removes the banknote from the first cassette, or when a person who is not authorized to remove the first cassette from the cassette accommodation unit removes the first cassette from the cassette accommodation unit, and wherein the controller switches on and off an operation of the ink spray unit, and the controller controls the ink spray unit such that the operation of the ink spray unit is switched on when the leaving mode is performed.

12. A banknote processing method performed by a banknote processing machine including: a transport unit configured to transport a banknote inside the banknote processing machine; a plurality of storing/feeding units each of which is connected to the transport unit and configured to store the banknote therein and to feed out the stored banknote; a first cassette connected to the transport unit and configured to store the banknote therein and to feed out the stored banknote; and an ink spray unit configured to spray ink toward the banknote stored in the first cassette, the banknote processing method comprising:

feeding out the banknote from each of the storing/feeding units, transporting the banknote to the first cassette by the transport unit, and storing and leaving the banknote in the first cassette.

13. The banknote processing method of claim 12, the banknote processing machine further including a cassette accommodation unit configured to detachably accommodate the first cassette, the banknote processing method further comprising accommodating the first cassette in the cassette accommodation unit, wherein the banknote is fed out from each of the storing/feeding units, transported to the first cassette by the transport unit, and stored and left in the first cassette, when the first cassette is accommodated in the cassette accommodation unit.

14. The banknote processing method according to claim 13, wherein a second cassette configured to store the banknote is also detachably accommodated in the cassette accommodation unit, the banknote processing method further comprising:

accommodating the second cassette in the cassette accommodation unit; and feeding out the banknotes of an excess amount, which is a difference between an amount of the banknotes in the banknote processing machine and an amount of change fund, from each of the storing/feeding units, transporting the banknotes of the excess amount to the second cassette by the transport unit, and storing the banknotes of the excess amount in the second cassette, when the second cassette is accommodated in the cassette accommodation unit, wherein the second cassette is taken out from the cassette accommodation unit after the banknotes of the excess amount are stored in the second cassette, then the first cassette is accommodated in the cassette accommodation unit, and the banknotes of change fund are stored and left in the first cassette.

* * * * *